US009354555B2

(12) United States Patent
Maehara

(10) Patent No.: US 9,354,555 B2
(45) Date of Patent: May 31, 2016

(54) TONER SUPPLYING DEVICE AND IMAGE FORMING APPARATUS

(71) Applicant: SHARP KABUSHIKI KAISHA, Osaka-shi, Osaka (JP)

(72) Inventor: Hiroyoshi Maehara, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/505,089

(22) Filed: Oct. 2, 2014

(65) Prior Publication Data

US 2015/0277293 A1 Oct. 1, 2015

(30) Foreign Application Priority Data

Mar. 31, 2014 (JP) ..... 2014-071653

(51) Int. Cl.
*G03G 15/08* (2006.01)

(52) U.S. Cl.
CPC ..... *G03G 15/0891* (2013.01); *G03G 15/0839* (2013.01); *G03G 15/0877* (2013.01)

(58) Field of Classification Search
CPC ..... G03G 15/0839; G03G 15/0877; G03G 15/0891
USPC ..... 399/258
See application file for complete search history.

(56) References Cited

U.S. PATENT DOCUMENTS

| | | | | |
|---|---|---|---|---|
| 7,463,859 | B2 * | 12/2008 | Ito | G03G 15/1685 399/358 |
| 8,249,471 | B2 * | 8/2012 | Kawahara | G03G 21/12 399/101 |
| 8,417,155 | B2 * | 4/2013 | Fukushima et al. | 399/167 |
| 2012/0243886 | A1 * | 9/2012 | Sunayama | G03G 15/0865 399/27 |
| 2013/0216288 | A1 * | 8/2013 | Murata et al. | 399/358 |

FOREIGN PATENT DOCUMENTS

JP 2012-198368 A 10/2012

* cited by examiner

*Primary Examiner* — David Gray
*Assistant Examiner* — Tyler Hardman
(74) *Attorney, Agent, or Firm* — Birch, Stewart, Kolasch & Birch, LLP

(57) ABSTRACT

It is enabled to prevent packing of toner and supply toner stably. A toner supplying device has a toner cartridge attached to an upper part thereof a storage tank in which toner supplied from the toner cartridge is stored temporarily and discharges the toner from a toner discharge port provided in a lower end of the storage tank. A conveyance screw for discharging the toner from the toner discharge port is provided inside the storage tank and the storage tank has a shaft support hole for supporting a shaft of the conveyance screw that coincides with a rotational center axis of the conveyance screw. The shaft support hole is formed as along hole in which the shaft is able to be displaced in one direction or a direction opposite to the one direction.

5 Claims, 14 Drawing Sheets

| | JUDGMENT | REMARKS |
|---|---|---|
| q − d = 2g | A | THERE IS NO PACKING ALSO ON WALL SURFACE |
| q − d = 0, g > 1mm | B | THERE REMAINS PACKING ON WALL SURFACE |
| q − d = 0, g = 0 | C | NOT-ALLOWED BECAUSE OF DESIGN CONFIGURATION |

| | | AREA P2 | AREA P3 |
|---|---|---|---|
| ROTATIONAL DIRECTION | R1 | A | C |
| | R2 | C | A |

FIG.10

| | | θ (° ) | | | | | |
|---|---|---|---|---|---|---|---|
| | | 12 | 15 | 25 | 35 | 45 | 50 |
| g (mm) | 0.1 | | CC | C | C | B | |
| | 0.3 | | A | A | A | A | |
| | 0.5 | | AA | AA | AA | AA | |
| | 0.7 | | AA | AA | AA | AA | |
| | 1.0 | B | AA | AA | AA | AA | B |
| | 1.2 | | A | A | A | A | |
| | 1.5 | | B | C | C | C | |

AA・・・VERY EXCELLENT
A・・・EXCELLENT
B・・・WITH TONER PACKING OR SLIPPING
C・・・NOT-ALLOWED
CC・・・PROMINENTLY NOT-ALLOWED

TONER SUPPLYING DEVICE AND IMAGE FORMING APPARATUS

CROSS-NOTING PARAGRAPH

This non-provisional application claims priority under 35 U.S.C. §119(a) on Patent Application No. 2014-071653 filed in JAPAN on Mar. 31, 2014, the entire contents of which are hereby incorporated herein by reference.

FIELD OF THE INVENTION

The present invention relates to a toner supplying device and an image forming apparatus, and more specifically relates to a toner supplying device that has a storage tank in which toner supplied from a toner cartridge is temporarily stored and discharges the toner from a toner discharge port provided in a lower end of the storage tank to supply to a developing device, and an image forming apparatus provided with the toner supplying device.

BACKGROUND OF THE INVENTION

Electrophotographic image forming apparatuses such as a copier, a printer and a facsimile have been known. These image forming apparatuses form an electrostatic latent image on a surface of a photoreceptor, develop this electrostatic latent image with toner, and transfer and fix the obtained toner image onto a recording medium such as a sheet of paper.

The toner used for developing the electrostatic latent image is supplied from a toner cartridge to a developing device via a toner conveyance path and supplied from the developing device to the surface of the photoreceptor. In a configuration where the toner cartridge is provided above the developing device, a toner conveyance path that extends vertically is provided.

As to a configuration for conveying toner supplied from a toner cartridge to a developing device, for example, a toner replenishment device described in Japanese Laid-Open Patent Publication No. 2012-198368 is provided with a toner receiving port, a feed portion for feeding toner from the toner receiving port into the device, a toner detector for detecting that the device has been filled with a specified amount of the toner, an agitating member that rotates to agitate the toner in the device, a rotational angle detector for detecting a rotational angle of the agitating member, and a recognition portion for recognizing the rotational angle of the agitating member based on output from the rotational angle detector. The toner is fed to the feed portion, when a position of an end edge of an agitating blade included in the agitating member is within a predetermined range not blocking a flow path of the toner from the toner receiving port to the toner detector based on the recognition by the recognition portion. This causes the replenished toner to reach a detector without being blocked by the agitating member, and it is possible to detect quickly and correctly that the toner has been replenished so as to reach a specified amount.

The toner conveyance path that extends vertically is configured as, for example, a conveyance pipe in a pipe shape, and the toner supplied from the toner cartridge passes through the inside of the conveyance pipe in a downward direction and is supplied to the developing device. In this case, the toner is packed inside the conveyance pipe and the conveyance pipe is blocked to impair a conveyance function. For example, in recent years, with improvement in image quality of an image forming apparatus, a particle size of the toner has become finer consequently. Generally, the fine toner has worse fluidity, and the toner is packed more easily in a toner conveyance path of a toner conveyance device.

The toner replenishment device of Japanese Laid-Open Patent Publication No. 2012-198368 is configured as an intermediate hopper for replenishing the toner supplied from the toner cartridge to the developing device, and is provided with the agitating member to agitate the toner for agitating, but the toner is packed in some cases only with the configuration of the agitating member, and a configuration for suppressing packing of the toner effectively is required. Moreover, Japanese Laid-Open Patent Publication No. 2012-198368 is for agitating the toner by the agitating member provided in an almost middle part of the intermediate hopper, and not for effectively preventing packing of the toner in a vicinity of a conveyance screw where packing easily occurs, for example, in a vicinity of a discharge port of the toner.

SUMMARY OF THE INVENTION

An object of the present invention is to provide a toner supplying device for supplying toner of a toner cartridge to a developing device, in which packing of the toner is prevented to allow the toner to be supplied stably, and an image forming apparatus provided with the toner supplying device.

An object of the present invention is to provide a toner supplying device having a toner cartridge attached to an upper part thereof and a storage tank in which toner supplied from the toner cartridge is stored temporarily and discharging the toner from a toner discharge port provided in a lower end of the storage tank, wherein a conveyance screw for discharging the toner stored in the storage tank temporarily to the toner discharge port is provided inside the storage tank, and the storage tank has a shaft support hole for supporting a shaft of the conveyance screw that coincides with a rotational center axis of the conveyance screw and the shaft support hole is formed as a long hole in which the shaft is able to be displaced in one direction or a direction opposite to the one direction.

Another object of the present invention is to provide the toner supplying device, wherein a driving portion for rotationally driving the conveyance screw is included, a driving gear that is driven by the driving portion and a driven gear attached to the shaft are engaged to rotationally drive the conveyance screw, and rotation of the driving gear allows a position of the shaft supported in the long hole to be displaced.

Another object of the present invention is to provide the toner supplying device, wherein the driving portion switches a rotational direction of the conveyance screw to both forward and reverse for driving.

Another object of the present invention is to provide the toner supplying device, wherein the conveyance screw is provided so that a rotational axis coincides with a horizontal direction at a lower part of the storage tank, the storage tank has a bottom part wall having a shape along an external shape of the conveyance screw, the toner discharge port is provided in a portion of area of the bottom part wall that is in an axis direction of the conveyance screw, and the rotation of the conveyance screw causes the toner stored in the lower part of the storage tank to be discharged downward from the toner discharge port.

Another object of the present invention is to provide a toner supplying device having a toner cartridge attached to an upper part thereof and a storage tank in which toner supplied from the toner cartridge is stored temporarily and discharging the toner from a toner discharge port provided in a lower end of the storage tank, wherein the storage tank is provided with a conveyance screw for discharging the toner temporarily stored in the storage tank to the toner discharge port, the conveyance screw is provided so that a rotational center axis coincides with a horizontal direction at a lower part of the storage tank, the storage tank has a bottom part wall having a shape along an external shape of the conveyance screw at the lower part of the storage tank and side walls that are connected to the bottom part wall and extend toward an upper part of the storage tank in both sides with an axis of the conveyance screw sandwiched therebetween, and one side wall among the side walls in the both sides of the conveyance screw is extended upward in a vertical direction and the other side wall is inclined to an inner side of the storage tank only by an angle θ with respect to the vertical direction, and when a gap between an inner surface of the storage tank and a part where the conveyance screw has a maximum diameter is g, $0.3 \leq g \leq 1.2$ and $15° \leq \theta \leq 45°$ are satisfied.

Another object of the present invention is to provide an image forming apparatus including the toner supplying device for performing image formation on a recording medium with toner supplied by the toner supplying device.

BRIEF DESCRIPTION OF THE DRAWINGS

FIG. 10 is a diagram showing a result of evaluation of packing in a relation of an angle to a vertical direction of a side wall of the storage tank and a gap between the conveyance screw and an inner surface of the storage tank;

PREFERRED EMBODIMENTS OF THE INVENTION

Entire Configuration of Image Forming Apparatus

Figure 1:
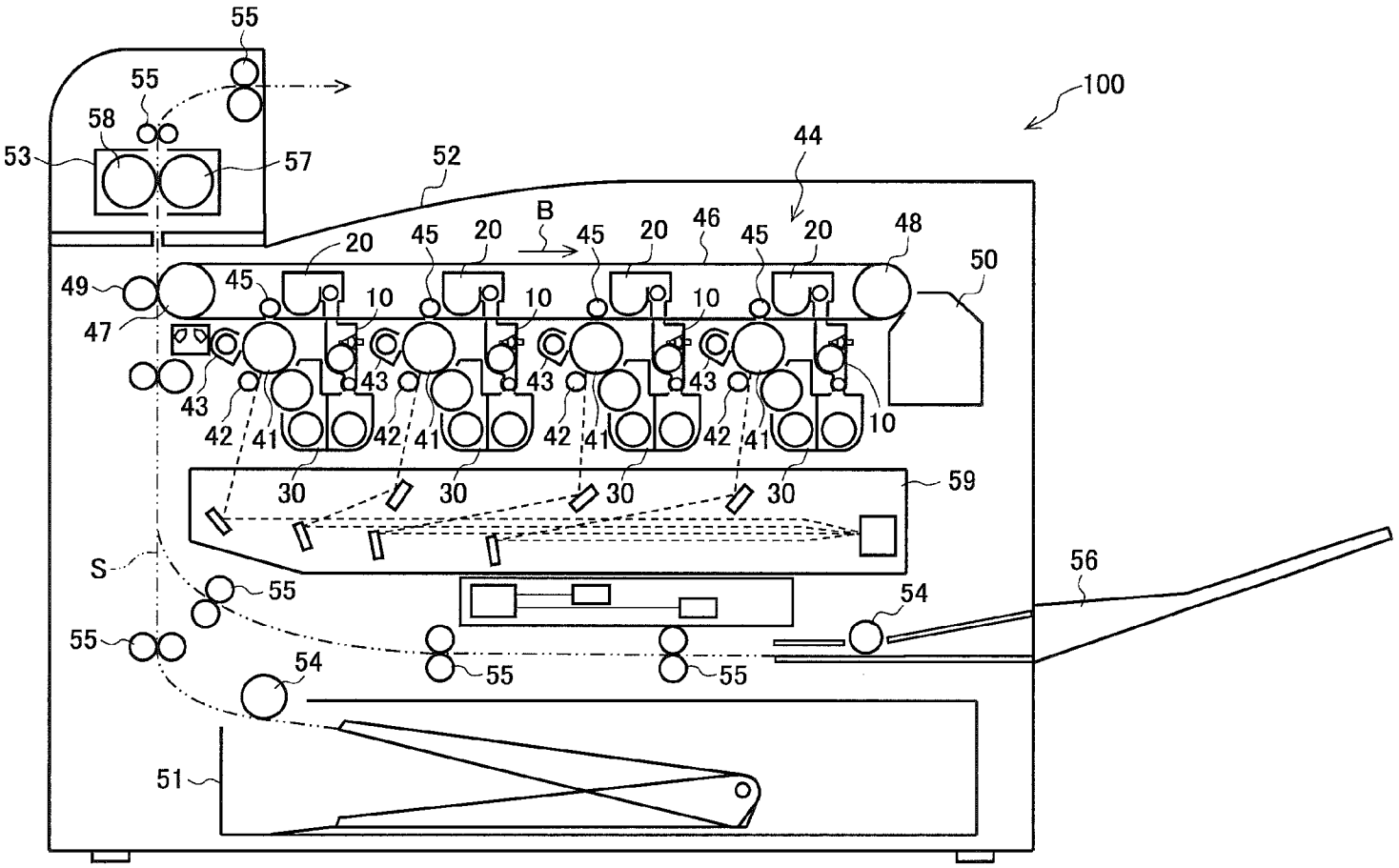
FIG. 1 is a diagram showing a configuration of one embodiment of an image forming apparatus according to the present invention.

FIG. 1 is a diagram showing a configuration of one embodiment of an image forming apparatus according to the present invention. An image forming apparatus 100 is configured as a full color printer capable of forming a color image on a recording medium such as a sheet of recording paper according to image data input from outside.

In the present embodiment, though the image forming apparatus is configured as a printer, a copier, a facsimile device, a multi-functional peripheral having these functions, or the like for performing image formation on a recording medium according to image data input from outside or image data read from a document by a scanner is applicable as the image forming apparatus.

Image data of a color image handled in the image forming apparatus 100 corresponds to a color image using respective colors of black (K), cyan (C), magenta (M) and yellow (Y). Therefore, developing devices 30, photoreceptor drums 41, chargers 42 and cleaner units 43 are respectively provided in four sets so as to form four types of latent images corresponding to the respective colors, so that four image stations are configured.

In each of the image stations, the photoreceptor drums 41 are disposed in an upper part of the image forming apparatus 100. The chargers 42 charge surfaces of the photoreceptor drums 41 uniformly to predetermined potential. An exposure unit 59 exposes the charged photoreceptor drums 41 according to input image data to thereby form electrostatic latent images according to the image data on the surfaces of the photoreceptor drums 41.

The respective developing devices 30 visualize the electrostatic latent images formed on the photoreceptor drums 41 with toner of K, C, M and Y, respectively. The cleaner units 43 remove and collect toner remaining on the surfaces of the photoreceptor drums 41 after development and image transfer steps.

In the developing device 30, a toner supplying device 10 is disposed and a toner cartridge 20 is attached to an upper part of the toner supplying device 10. The toner supplying device 10 functions as a conveyance path in which toner supplied from the toner cartridge 20 is conveyed to the developing device 30 as well as functions as an intermediate hopper in which toner is accumulated temporarily. The toner supplied from the toner cartridge 20 to the toner supplying device 10 is held at a fixed amount in a storage tank of the toner supplying device 10 and supplied to the developing device 30. Here, the toner supplying device 10 is configured in a vertically-long shape in which the conveyance path is formed in a vertical direction.

An intermediate transfer belt unit 44 is disposed above the photoreceptor drums 41. The intermediate transfer belt unit 44 is provided with intermediate transfer rollers 45, an intermediate transfer belt 46, an intermediate transfer belt driving roller 47, an intermediate transfer belt driven roller 48. The intermediate transfer belt 46 is stretched and rotationally driven in a direction of an arrow B.

The intermediate transfer rollers 45 apply a transfer bias for transferring the toner images on the photoreceptor drums 41 onto the intermediate transfer belt 46. The intermediate transfer belt 46 is provided so as to be contact with each of the photoreceptor drums 41. The toner images of the respective colors formed on the photoreceptor drums 41 are transferred so as to be sequentially superimposed, so that a color toner image (multicolor toner image) is formed on the intermediate transfer belt 46.

With the rotation of the intermediate transfer belt 46, the toner images laminated on the intermediate transfer belt 46 move to a position where a conveyed sheet of recording paper is in contact with the intermediate transfer belt 46, and are transferred onto the sheet of recording paper by a transfer roller 49 that is disposed at this position. The toner remaining on the intermediate transfer belt 46 is removed and collected by an intermediate transfer belt cleaning unit 50.

A paper feed tray 51 is for accumulating a sheet of recording paper for use in image formation and a paper discharge tray 52 is for placing a sheet subjected to image formation face-down. Moreover, a sheet of recording paper is also able to be supplied from a manual tray 56.

The image forming apparatus 100 is provided with a sheet conveyance path S through which a sheet of recording paper of the paper feed tray 51 or the manual tray 56 is sent to the paper discharge tray 52 via the transfer roller 49 and a fixing unit 53. Arranged along this sheet conveyance path S from the paper feed tray 51 and the manual tray 56 to the paper discharge tray 52 are pickup rollers 54, conveyance rollers 55, the fixing unit 53 and the like.

The fixing unit 53 is provided with a heat roller 57, a pressure roller 58 and the like which rotate with the sheet of recording paper sandwiched therebetween. The heat roller 57 is controlled so as to be at a predetermined fixing temperature, and thermally presses the sheet of recording paper with the pressure roller 58, thereby fusing, mixing, and bringing into pressed contact the toner images of each color transferred onto the sheet of recording paper for thermally fixing. The sheet of recording paper on which toner is thermally fixed is discharged onto the paper discharge tray 52.

Figure 2A:
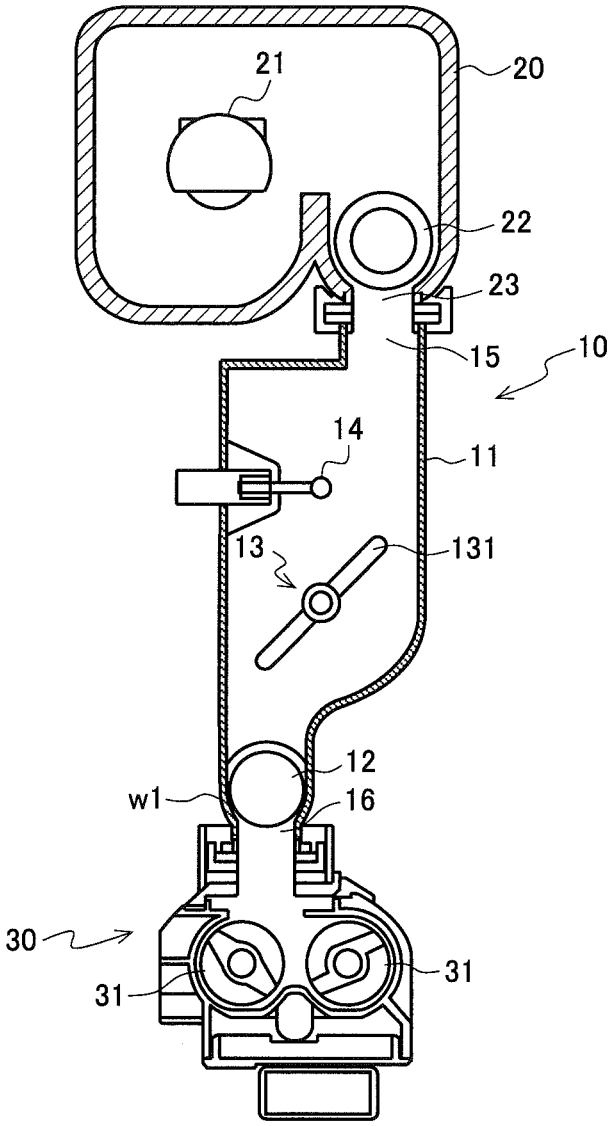
FIG. 2A is a diagram explaining an exemplary configuration of a toner supplying device according to the present invention.
Figure 2B:
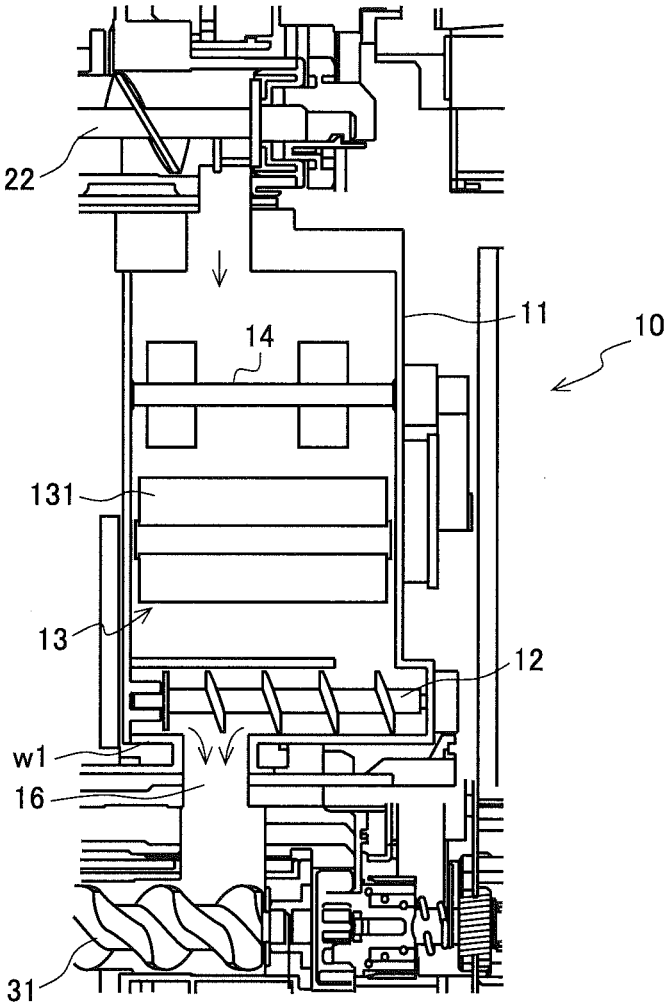
FIG. 2B is another diagram explaining an exemplary configuration of the toner supplying device according to the present invention.

FIG. 2A and FIG. 2B are diagrams explaining an exemplary configuration of the toner supplying device according to the present invention, and FIG. 2A is a configuration schematic view of the toner supplying device that connects between a toner cartridge and a developer when viewed from an axis direction of a conveyance screw thereof and FIG. 2B is a configuration schematic view of the toner supplying device when viewed from a side. In FIG. 2B, only a toner conveyance member is illustrated for the toner cartridge and a development container.

The toner supplying device 10 has the toner cartridge 20 attached to an upper part thereof. The toner cartridge 20 is provided with an agitating member 21 and a toner conveyance member 22, and toner discharged from a toner discharge port 23 is supplied to the inside of a storage tank 11 of the toner supplying device 10. The storage tank 11 is provided with a toner supplying port 15 through which the toner discharged from the toner cartridge 20 is supplied at an upper part thereof as well as provided with a toner discharge port 16 for discharging the toner at a bottom part of the storage tank 11, and has a shape that is vertically long in a vertical direction.

The toner supplying device 10 has a function not as a simple toner conveyance path but as an intermediate hopper in which the toner supplied from the toner cartridge 20 is reserved temporarily. Though a capacity of the storage tank 11 is not limited, for example, even when the toner in the toner cartridge 20 runs out, it is possible to temporarily keep a fixed amount of toner to the extent that image formation is possible.

The storage tank 11 is provided with an agitating member 13 for agitating the reserved toner. The agitating member 13 is provided with an agitating blade 131 and rotates the agitating blade 131 to thereby agitate the toner reserved in the storage tank 11 to prevent packing of the toner for smooth conveyance. Here, a tip end of the agitating blade 131 passes through a vicinity of a wall surface of the storage tank 11 with a predetermined gap from the wall surface, thus making it possible to agitate the toner inside the storage tank 11 as well as scrape the toner adhered to an inner wall surface of the storage tank 11 effectively.

Moreover, inside the storage tank 11, a remaining amount detecting sensor 14 for detecting a remaining amount of the toner is disposed at a predetermined position in a height direction of the storage tank 11. Thereby, it is detected that the remaining amount of the toner in the storage tank 11 is at a fixed level or less and it is possible to notify a user with a predetermined method by using the detection result. With the notification, the user is able to recognize the remaining amount of the toner in the toner supplying device 10 that functions as the intermediate hopper. That is, a not-shown remaining amount sensor in the toner cartridge 20 makes it possible to detect near end of the toner, and further, the remaining amount detecting sensor 14 in the storage tank 11 makes it possible to detect toner end indicating that the usable toner almost runs out.

The storage tank 11 has a conveyance screw 12 for discharging the toner, which is supplied from the toner cartridge 20 and stored in the storage tank 11 temporarily, to the toner discharge port 16.

The conveyance screw 12 is provided so that a rotational axis thereof is coincided with a horizontal direction at the lower part of the storage tank 11. The storage tank 11 has a bottom part wall w1 having a shape along an external shape of the conveyance screw 12 at a bottom part thereof, and the toner discharge port 16 is provided in a partial area of the bottom part wall w1 in an axis direction of the conveyance screw 12. Then, by rotating the conveyance screw 12, the toner reserved in the lower part of the storage tank 11 is discharged downward from the toner discharge port 16.

The developing device 30 is disposed in a lower part of the toner supplying device 10. The developing device 30 supplies toner onto each photoreceptor drum 41 and visualizes an electrostatic latent image formed on the photoreceptor drum 41 with the toner. A conveyance screw 31 is provided in the developing device 30 for conveying the toner discharged from the toner discharge port 16 of the toner supplying device 10 to supply to the photoreceptor drum 41.

Embodiment 1

Figure 3:
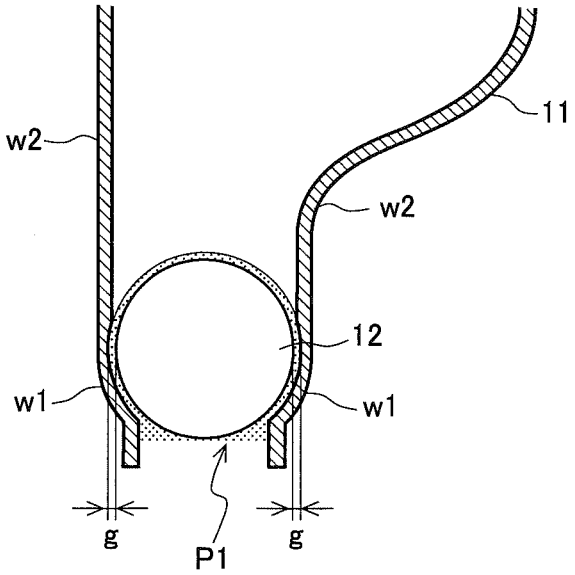
FIG. 3 is a diagram of a lower part of a storage tank of the toner supplying device when viewed from an axis direction of a conveyance screw.

FIG. 3 is a diagram of the lower part of the storage tank of the toner supplying device when viewed from an axis direction of the conveyance screw.

The storage tank 11 is provided with the conveyance screw 12 for discharging the toner, which is reserved in the storage tank 11 temporarily, to the toner discharge port 16. In this example, the conveyance screw 12 is provided so that the rotational axis coincides with the horizontal direction at the lower part of the storage tank 11.

The storage tank 11 has bottom part walls w1 having a shape along an outer diameter of the conveyance screw 12 at the lower part of the storage tank 11 and side walls w2 that are connected to the bottom part walls w1 and extend toward an upper part of the storage tank 11 in both sides with an axis of the conveyance screw 12 sandwiched therebetween, and an area P1 where the toner may be packed exists between the bottom part walls w1 and the side walls w2 and the conveyance screw 12.

In a first embodiment according to the present invention, packing of the toner in the area P1 around the conveyance screw 12 is prevented so that the toner is conveyed smoothly by the conveyance screw 12 to be discharged from the toner discharge port 16. A configuration therefor will be described below.

Figure 4:
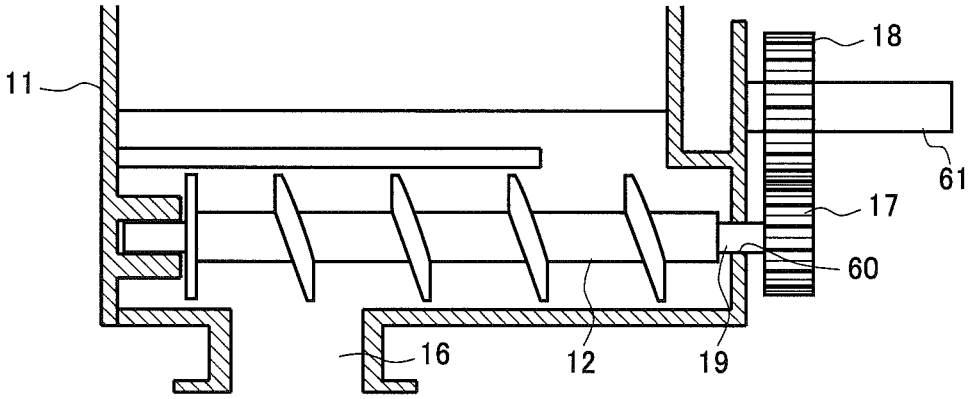
FIG. 4 is a diagram showing a schematic configuration of the lower part of the storage tank when viewed from a side of the conveyance screw.

FIG. 4 is a diagram showing a schematic configuration of the lower part of the storage tank when viewed from a side of the conveyance screw. The conveyance screw 12 is provided in the lower part of the storage tank 11 so that the toner reserved in the storage tank 11 is conveyed and discharged from the toner discharge port 16 toward the developing device 30.

A driving shaft 61 that is connected to a not-shown driving device (driving portion) for rotationally driving the conveyance screw 12 is provided outside the storage tank 11. A tip end part of the driving shaft 61 is supported by a housing of the storage tank 11 and a driving gear 18 is attached in a vicinity of an outer wall surface of the housing.

The conveyance screw 12 has a shaft 19 that is coincided with the rotational center axis thereof, and the shaft 19 is supported by a shaft support hole 60 provided in the housing of the storage tank 11 so that a tip end part of the shaft 19 protrudes outward from the storage tank 11. A driven gear 17 is attached to this tip end part of the shaft 19 so as to be engaged with the driving gear 18.

With this configuration, the driving shaft 61 is rotationally driven to thereby rotate the conveyance screw 12.

Figure 5A:
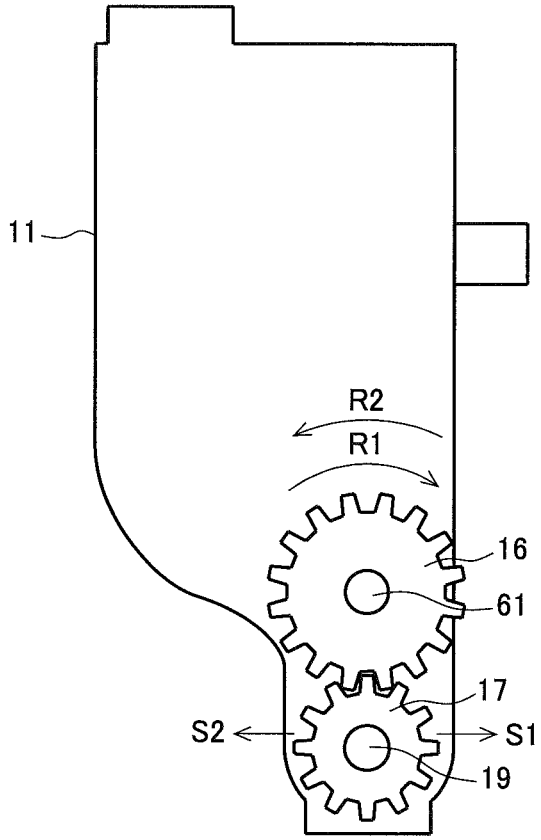
FIG. 5A is a diagram explaining an exemplary configuration of a support mechanism of the conveyance screw.
Figure 5B:
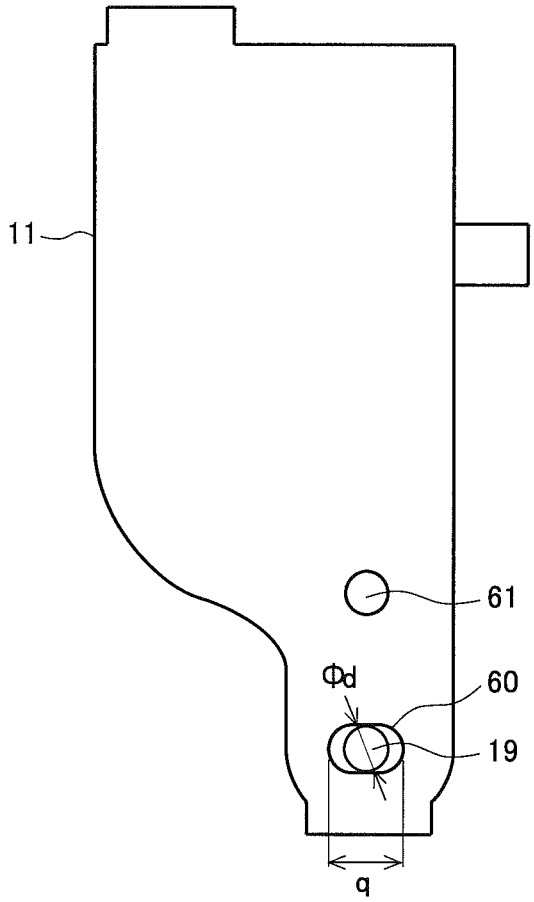
FIG. 5B is another diagram explaining an exemplary configuration of the support mechanism of the conveyance screw.

FIG. 5A and FIG. 5B are diagrams explaining an exemplary configuration of a support mechanism of the conveyance screw, and FIG. 5A is a diagram schematically showing a configuration of the driving gear and the driven gear attached in a vicinity of the wall surface of the storage tank 11 of the toner supplying device and FIG. 5B is a diagram showing an exemplary support configuration of the driving shaft 61 and the shaft 19 of the conveyance screw in the storage tank 11.

As a feature of the present embodiment, as shown in FIG. 5B, the shaft support hole 60 that is provided in the storage tank 11 for supporting the shaft 19 of the conveyance screw 12 is formed as a long hole in which the shaft 19 is able to be displaced in one direction or a direction opposite to the one direction. In the case of this example, the one direction is set as a direction that coincides with the horizontal direction.

As shown in FIG. 5A, when the driving gear 18 is caused to rotate in a direction of a rotational direction R1, stress is applied to the driven gear 17 that is attached to the shaft 19 of the conveyance screw 12 and the shaft 19 tries to move in a direction of S2. On the other hand, when the driving gear 18 is caused to rotate reversely in a direction of a rotational direction R2, the shaft 19 tries to move in a direction of S1. At this time, since the shaft support hole 60 is formed as the long hole in which the shaft 19 is able to be displaced in the direction of S1 and the direction of S2, which is an opposite direction thereto, it is displaced in the shaft support hole 60 formed into the long hole in accordance with the rotation of the driving gear.

Further, thereby, the conveyance screw 12 itself is displaced in the direction of S1 or S2. When a position of the conveyance screw 12 is displaced, it is possible to scrape the toner in the area P1 of FIG. 3 for conveying and discharging, and this makes it possible to prevent packing of the toner effectively.

Figures 6, 7, 8:
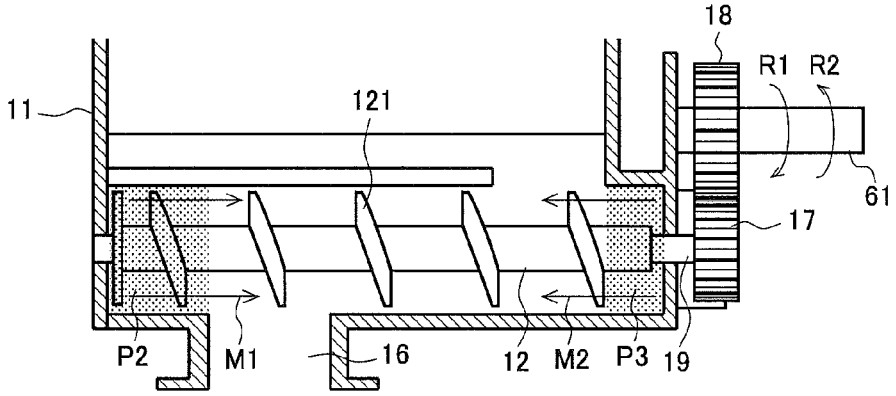
FIG. 6 is a diagram showing a result of evaluation of a toner packing state in a configuration for moving a shaft of the conveyance screw.
FIG. 7 is a diagram explaining an effect of scraping toner in both end parts of the conveyance screw.
FIG. 8 is a diagram showing a result of evaluation of a toner packing state in an end part of the conveyance screw when the conveyance screw is caused to rotate.

FIG. 6 is a diagram showing a result of evaluation of a toner packing state in a configuration for moving the shaft of the conveyance screw.

Here, as shown in FIG. 5B, a diameter of the shaft 19 of the conveyance screw 12 is set as d and a length in a long diameter direction of the shaft support hole 60 that is formed into the long hole is set as q. Moreover, as shown in FIG. 3, a distance between the conveyance screw 12 and an inner wall surface of the storage tank 11 is set as g. The distance g is set as a distance between the conveyance screw 12 in a largest outer diameter of the conveyance screw 12 (that is, an outermost peripheral part of a flight) and the inner wall surface of the storage tank 11. Then, a state of toner packing in the area P1 of FIG. 3 was evaluated.

As a result of the evaluation shown in FIG. 6, in the case of $q-d=2$ g, there was no toner packing in the wall surface, and judgment of the packing was excellent (A). Moreover, in the case of $q-d=0$ and $g>1$ mm, the remaining of the toner packing was caused in the wall surface and judgment of the packing was slightly excellent (B). Further, in the case of $q-d=0$ and $g=0$, due to tolerance, the conveyance screw 12 is not able to be disposed in the storage tank 11 and it is not allowed because of a design configuration, and therefore, judgment of the packing also becomes not-allowed (C).

As described above, by optimizing the diameter of the shaft 19 of the conveyance screw 12, the length in the long diameter direction of the shaft support hole 60 that is formed into the long hole shape, and the distance between the conveyance screw 12 and the inner wall surface of the storage tank 11 so as to allow the conveyance screw 12 to be displaced inside the storage tank 11, it is possible to scrape the toner adhered to the inner wall surface of the storage tank 11 to prevent packing of the toner appropriately.

Embodiment 2

In the configuration where the conveyance screw 12 is allowed to be displaced as described above, by further switching a rotational direction of the conveyance screw 12 to forward and reverse for driving, it is possible to prevent packing of toner more effectively.

FIG. 7 is a diagram explaining an effect of scraping toner in both end parts of the conveyance screw. The conveyance screw 12 is provided so that the rotational axis thereof is coincided with the horizontal direction at the bottom part of the storage tank 11. Here, areas P2 and P3 where the toner may be packed exist in the both end parts of the conveyance screw 12. For example, when the conveyance screw 12 is continued to rotate in a fixed direction, the toner resides in a tip end side thereof and possibility of causing packing is generated.

Therefore, in the present embodiment, by switching the rotational direction of the conveyance screw 12 to forward and reverse for driving, packing of the toner is prevented more effectively. In this case, a not-shown driving device that drives the driving shaft 61 is controlled to switch the rotational direction of the driving shaft 61 to forward and reverse in the present example. For example, by using a stepping motor as the driving device, a pulse signal for controlling the rotational direction of the stepping motor is switched, thus making it possible to switch the rotational direction of the driving shaft 61 to forward and reverse.

For example, when the driving shaft 61 is caused to rotate in the direction of the rotational direction R1, with rotation of the conveyance screw 12, a flight 121 of the conveyance screw moves in a direction M1, thus making it possible to scrape the toner in the area P2. On the other hand, when the driving shaft 61 is caused to rotate in the direction of the rotational direction R2, with the rotation of the conveyance screw 12, the flight 121 of the conveyance screw moves in a direction M2, thus making it possible to scrape the toner in the area P3. That is, by rotating while switching the rotational direction of the conveyance screw 12 to forward and reverse, it is possible to prevent packing in the areas of both ends of the conveyance screw 12 effectively.

FIG. 8 is a diagram showing a result of evaluation of a toner packing state in an end part of the conveyance screw when the conveyance screw is caused to rotate.

Here, by using the toner supplying device having the configuration as shown in FIG. 7, the driving device that drives the driving shaft 61 was controlled to cause the driving shaft to rotate in either direction of the rotational direction R1 or R2, and a state of toner packing in the areas P2 and P3 of the both end parts of the conveyance screw 12 at this time was observed. In FIG. 7, an excellent state where no toner packing is caused is indicated as A and a state of being not-allowed because toner packing is caused is indicated as C.

As a result of this, when the driving shaft 61 was caused to rotate in the direction of the rotational direction R1, the flight 121 of the conveyance screw moved in the direction M1, thus making it possible to scrape the toner in the area P2 and no toner packing was caused. At this time, in the area P3 in the opposite side, the toner was fed successively and toner packing was caused.

On the other hand, when the driving shaft 61 was caused to rotate in the direction of the rotational direction R2, the flight 121 of the conveyance screw 12 moved in the direction M2, thus making it possible to scrape the toner in the area P3 and no toner packing was caused. At this time, in the area P2 in the opposite side, the toner was fed successively and toner packing was caused.

In this manner, since it is possible to prevent packing by scraping the toner in one end side of the conveyance screw according to the rotational direction of the conveyance screw 12, by rotating while switching the rotational direction of the conveyance screw 12 between forward and reverse directions (R1 and R2), it becomes possible to suppress toner packing in the areas P2 and P3 of the both ends of the conveyance screw 12 effectively.

Note that, in the above-described example, though the rotational direction of the conveyance screw 12 is switched to forward and reverse for driving in the configuration where the shaft support hole 60 is the long hole so that the shaft 19 of the conveyance screw 12 is able to be displaced in one direction and the direction opposite thereto, the rotational direction of the conveyance screw 12 may be switched to forward and reverse in a mode having no configuration where the shaft support hole 60 is the long hole.

Embodiment 3

Figure 9:
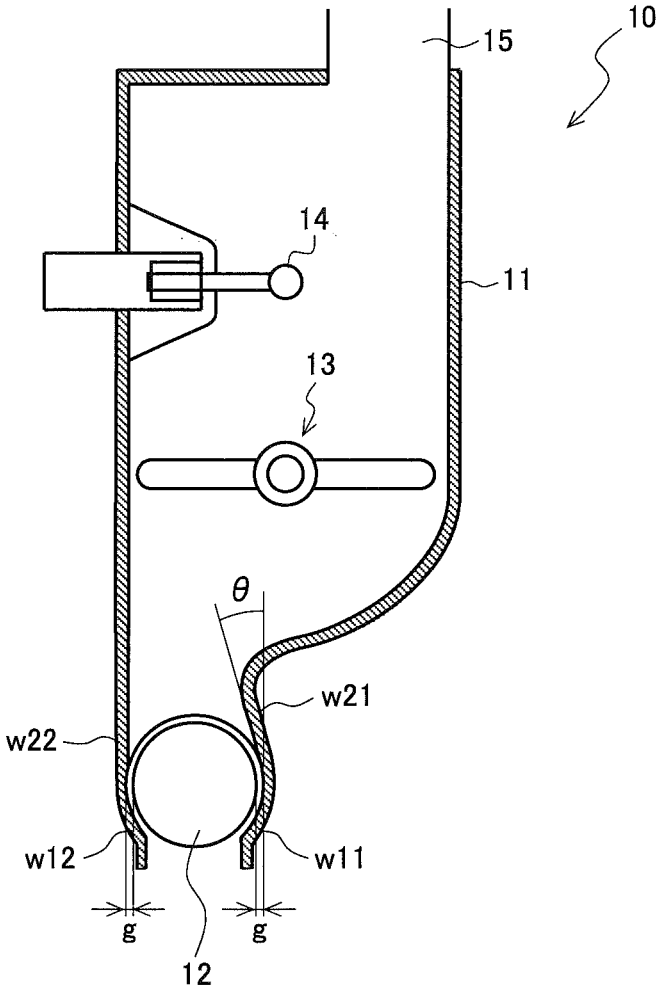
FIG. 9 is a diagram explaining an exemplary configuration of a wall part around the conveyance screw in the storage tank.

In the present embodiment, by optimizing an angle of a wall surface around the conveyance screw 12 that is disposed in the lower part of the storage tank 11 of the toner supplying device 10, packing of toner is suppressed effectively. FIG. 9 is a diagram explaining an exemplary configuration of a wall part around the conveyance screw in the storage tank.

In the same manner as each embodiment described above, the toner supplying device 10 of the present embodiment has the storage tank 11 in which toner supplied from the toner cartridge is temporarily stored and discharges the toner from the toner discharge port 16 provided in a lower end of the storage tank 11. The storage tank 11 is provided with the conveyance screw 12 for discharging the toner which is stored in the storage tank 11 temporarily to the toner discharge port 16. The conveyance screw 12 is provided so that the rotational axis thereof is coincided with the horizontal direction at the lower part of the storage tank 11.

Here, the storage tank 11 has bottom part walls w11 and w12 having a shape along an outer diameter of the conveyance screw 12 at the lower part of the storage tank 11 and side walls w21 and w22 that are connected to the bottom part walls w11 and w12, respectively, and are provided to extend toward an upper part of the storage tank 11 in both sides with the axis of the conveyance screw 12 sandwiched therebetween.

One side wall w22 among the side walls w21 and w22 in the both sides of the conveyance screw 12 is extended upward in a vertical direction and the other side wall w21 is inclined to an inner side of the storage tank 11 only by an angle θ to the vertical direction. Here, it is configured such that the toner supplying device 10 is disposed in the image forming apparatus 100 that is installed at a horizontal position, and when the axis direction of the conveyance screw 12 is coincided with the horizontal direction, one side wall w21 among the side walls in the both sides thereof is inclined to the inner side of the storage tank 11 only by the angle θ to the vertical direction.

In addition, when a gap between an inner surface of the storage tank 11 and a part where the conveyance screw 12 has a maximum diameter is g, by satisfying $0.3 \leq g \leq 1.2$ and $15° \leq \theta \leq 45°$, it is possible to prevent packing of the toner around the conveyance screw 12 effectively.

FIG. 10 is a diagram showing a result of evaluation of packing in a relation of the angle θ to the vertical direction of the side wall w21 and the gap g between the part where the conveyance screw 12 has the maximum diameter and the inner surface of the storage tank.

Here, as toner, one in which 7.5 wt % of carbon black was added to PES (polyether sulphone) as a main resin raw material was used. In this toner, an average particle diameter was about 7 μm, particles passing through an aperture of 5 μm was about 37%, and a coefficient of particle size distribution was about 30.

In the example of FIG. 10, the gap g between the conveyance screw 12 and the storage tank 11 was set at an interval of 0.2 mm from 0.1 to 1.5 mm and the angle θ of the side wall was set as 12, 15, 25, 35, 45 and 50°, and the states of the toner around the conveyance screw in these cases were evaluated. In the figure, it is indicated such that a state where the evaluation result was very excellent is AA, an excellent state is A, a state with toner packing or slipping is B, a not-allowed state is C and a prominently not-allowed state is CC.

As a result of this, when the gap g was in a range of 0.3 to 1.2 mm and the angle θ was in a range of 15 to 45°, packing of the toner was not caused and the excellent result was obtained. Moreover, when the angle θ was in a range of 15 to 45° and the gap g is 0.5 to 1.0 mm, the particularly excellent result was obtained.

On the other hand, when the gap g was 0.1 mm, packing of the toner was caused with any angle θ. Particularly when the angle θ was smaller, degree of packing became great.

Further, when the gap g was 1.5 mm, the extent that the toner slips through a space between the conveyance screw 12 and the inner wall of the storage tank 11 became large and sufficient conveyance became impossible, thus making it impossible to discharge the toner stably.

As described above, in the present embodiment, one side wall w21 of the side walls in the both sides of the conveyance screw 12 is inclined to the inner side of the storage tank 11 only by the angle θ with respect to the vertical direction, and when the gap between the inner surface of the storage tank 11 and the part where the conveyance screw has the maximum diameter is g, by satisfying $0.3 \leq g \leq 1.2$ and $15° \leq \theta \leq 45°$, it is possible to perform excellent conveyance of the toner without causing packing of the toner around the conveyance screw, thus making it possible to feed the toner reserved in the storage tank 11 to the developing device stably.

Embodiment 4

Figure 11A:
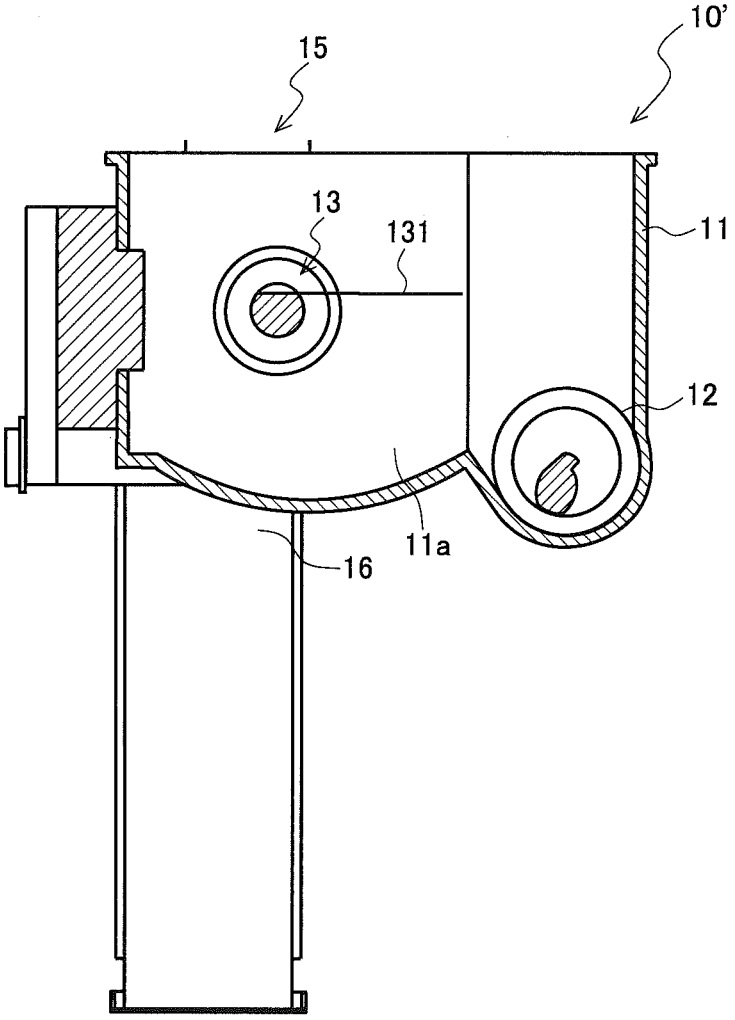
FIG. 11A is a diagram explaining another exemplary configuration of a toner supplying device according to the present invention.
Figure 11B:
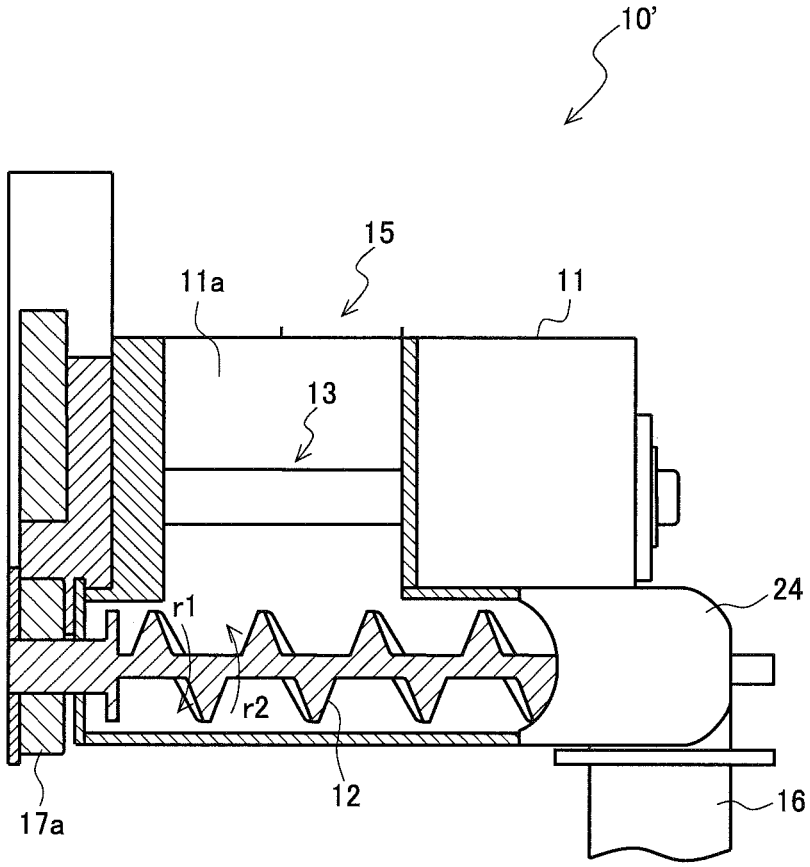
FIG. 11B is another diagram explaining another exemplary configuration of the toner supplying device according to the present invention.
Figure 11C:
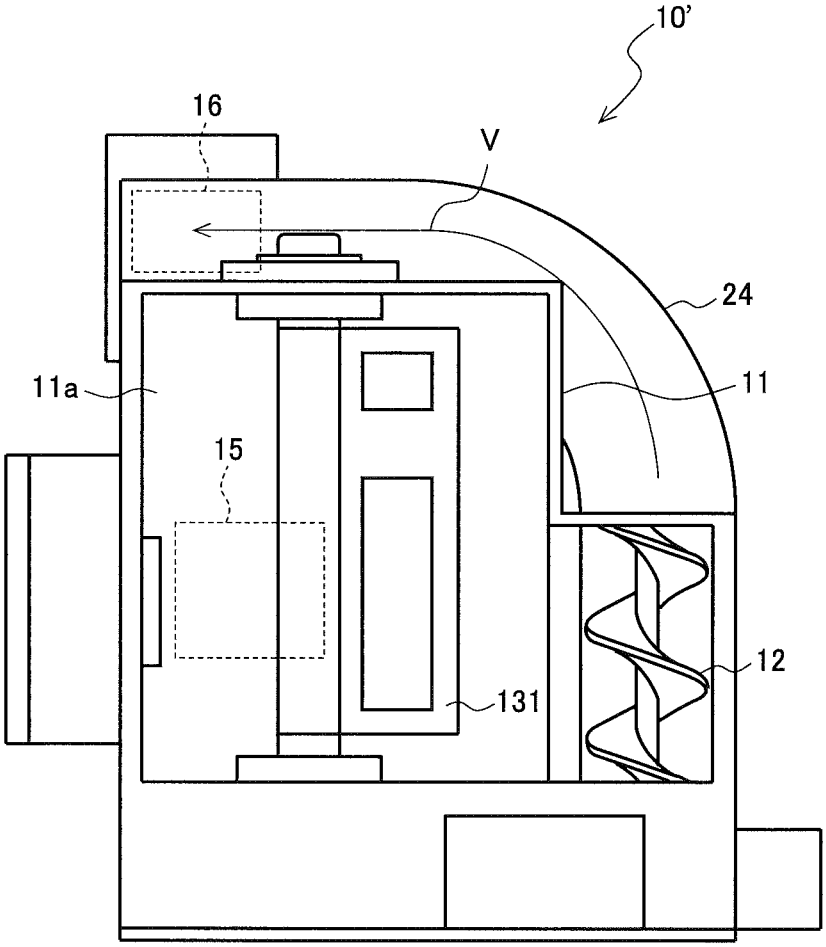
FIG. 11C is still another diagram explaining another exemplary configuration of the toner supplying device according to the present invention.

FIG. 11A to FIG. 11C are diagrams explaining another exemplary configuration of a toner supplying device according to the present invention, and FIG. 11A is a configuration schematic diagram of the toner supplying device that connects between the toner cartridge and the developer when viewed from the axis direction of the conveyance screw thereof, FIG. 11B is a configuration schematic diagram of the toner supplying device when viewed from the side and FIG. 11C is a configuration schematic diagram of the toner supplying device when viewed from above.

In the same manner as the configuration of FIG. 2A and FIG. 2B, a toner supplying device 10' of the present embodiment has a toner cartridge (not shown in the present figures) attached at an upper part thereof and is provided with the storage tank 11 in which toner supplied from the toner cartridge is stored temporarily. The storage tank 11 is provided with the toner supplying port 15 through which the toner supplied from the toner cartridge is supplied into the storage tank 11 at the upper part thereof as well as provided with the toner discharge port 16 through which the toner stored in the storage tank 11 temporarily is discharged at the lower end of the storage tank 11. Further, the conveyance screw 12 for conveying the toner toward the toner discharge port 16 is provided inside the storage tank 11.

Moreover, the storage tank 11 is provided with the agitating member 13 for agitating the supplied toner. The agitating member 13 is provided with the agitating blade 131 and rotates the agitating blade 131 to thereby agitate the toner reserved in the storage tank 11 to prevent packing of the toner for smooth conveyance.

The conveyance screw 12 is provided so that the rotational axis thereof is coincided with the horizontal direction at the lower part of the storage tank 11. In the present example, the conveyance screw 12 is disposed at a position deviated to a side with respect to a position where the toner is supplied from the toner supplying port 15 of the storage tank 11. The toner supplied from the toner supplying port 15 drops to downward thereof. Then, while being agitated by the agitating member 13, the toner reaches the conveyance screw 12 and is conveyed by the conveyance screw 12.

A toner conveyance path 24 has a tubular space that is connected to an internal space 11*a* of the storage tank 11 in which the agitating member 13 is disposed, and the tubular space is formed into a shape curved in the horizontal direction. Further, the toner discharge port 16 for discharging the toner downward is provided at a terminal part of the toner conveyance path 24. The conveyance screw 12 has a driven gear (third driven gear) 17*a* (FIG. 11B) connected in a base end side thereof, and is driven by driving force from a driving gear connected by a not-shown driving motor.

It is configured such that a part of the base end side of the conveyance screw 12 is exposed inside the internal space 11*a* in which the agitating member 13 is disposed, and the tip end side thereof is stretched in the curved toner conveyance path 24 and curved along an arrow V of FIG. 11C, and the tip end of the conveyance screw 12 is positioned above the toner discharge port 16. The conveyance screw 12 is formed with a flexible member such as rubber and is able to rotate inside the curved toner conveyance path 24. The conveyance screw 12 has the shaft 19 that is coincided with the rotational center axis thereof, and the shaft 19 is supported by the shaft support hole 60 provided in the housing of the storage tank 11 so that a tip end part of the shaft 19 protrudes outward from the storage tank 11 and the third driven gear 17*a* is attached. The third driven gear 17*a* is driven by a driving mechanism shown below, and thereby the conveyance screw 12 rotates.

Figure 12A:
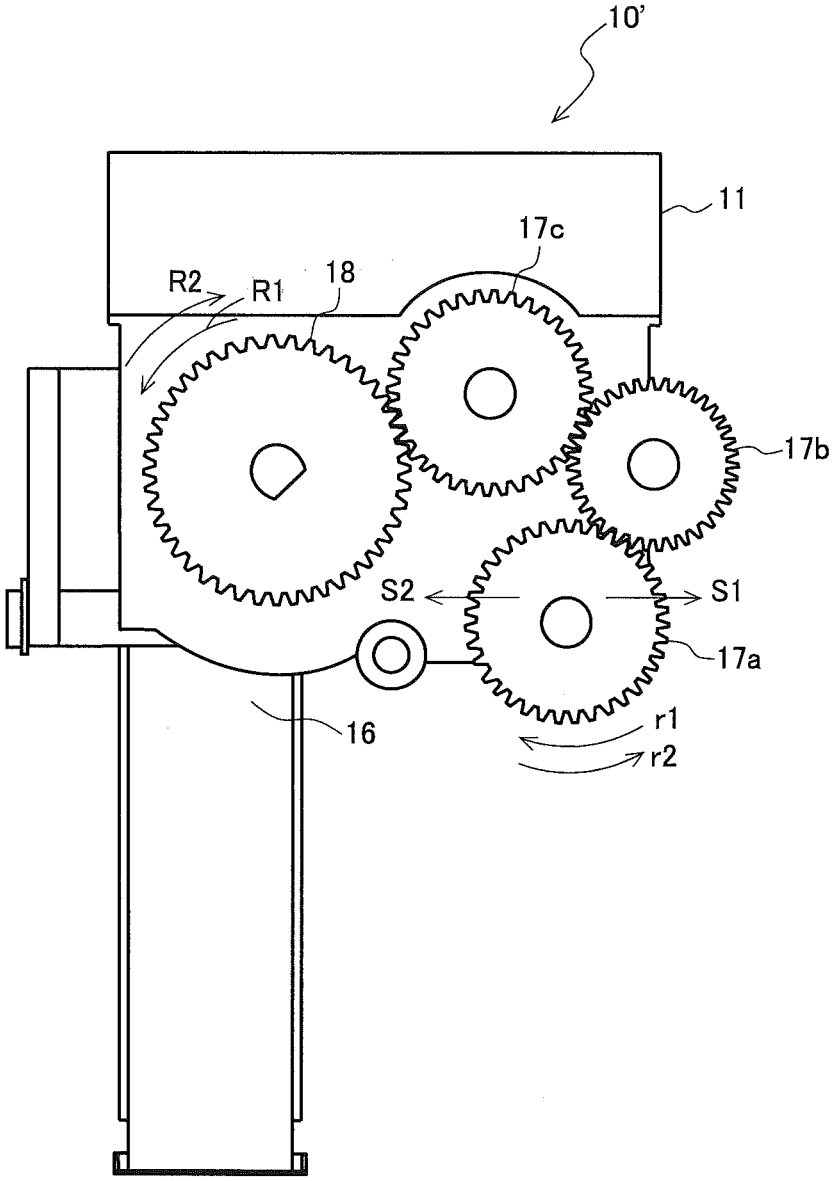
FIG. 12A is a diagram explaining an exemplary configuration of the support mechanism and a driving mechanism of the conveyance screw.
Figure 12B:
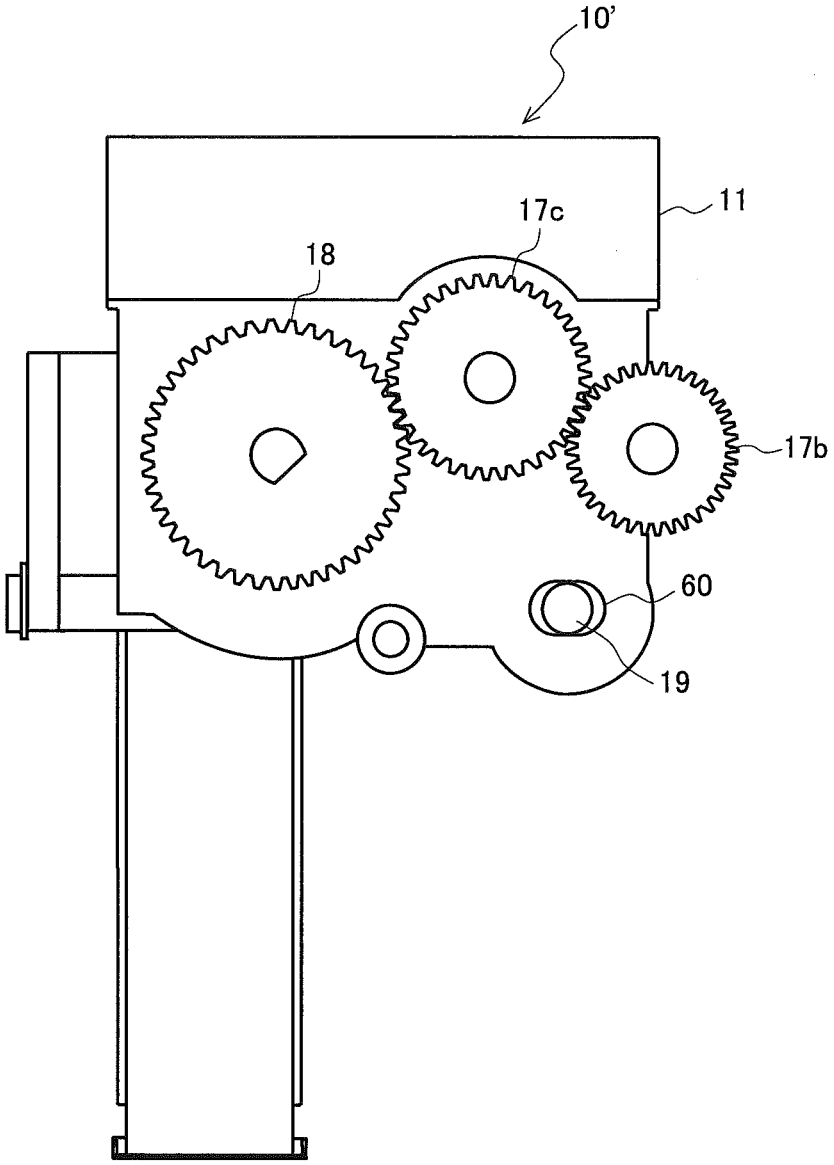
FIG. 12B is another diagram explaining an exemplary configuration of the support mechanism and the driving mechanism of the conveyance screw.

FIG. 12A and FIG. 12B are diagrams explaining an exemplary configuration of the support mechanism and the driving mechanism of the conveyance screw, and FIG. 12A is a diagram schematically showing a configuration of the driving gear and the driven gear that are attached in a vicinity of the wall surface of the storage tank 11 of the toner supplying device and FIG. 12B is a diagram showing a state where the driven gear attached to the shaft 19 of the conveyance screw is omitted and the support mechanism of the shaft 19 is exposed.

The driving gear 18 that is driven by a not-shown driving device (driving portion) is attached to a wall surface of the housing of the storage tank 11. Rotation of the driving gear 18 is transmitted to a first driven gear 17*c*, a second driven gear 17*b* and the third driven gear 17*a* in sequence. The third driven gear 17*a* is attached to the shaft 19 of the conveyance screw 12 as described above. Accordingly, by driving the driving gear 18 by the driving device, driving force is transmitted to the third driven gear 17*a* and the conveyance screw 12 rotates. Note that, the above-described disposition configuration of the driving gear and the driven gears shows one example and the number and disposition thereof are designed appropriately.

In the same manner as the embodiment 1, the toner conveyance device of the present embodiment is able to be configured such that the shaft support hole 60 that is provided in the storage tank 11 for supporting the conveyance screw 12 is formed as a long hole in which the conveyance screw 12 is able to be displaced in one direction and a direction opposite thereto.

As shown in FIG. 12A, when the driving gear 18 is caused to rotate in a direction of a rotational direction R1, the rotation of the driving gear 18 is transmitted to the first driven gear 17*c*, the second driven gear 17*b* and the third driven gear 17*a* in sequence, and the third driven gear 17*a* that is attached to the shaft 19 of the conveyance screw 12 rotates in a direction of a rotational direction r1.

Then, as shown in FIG. 12B, the shaft support hole 60 that is provided in the storage tank 11 for supporting the shaft 19 of the conveyance screw 12 is formed as the long hole so that the shaft 19 is able to be displaced in one direction or the direction opposite to the one direction. In the case of this example, the one direction is set as a direction that coincides with the horizontal direction.

When the driving gear is caused to rotate in the direction of the rotational direction R1, stress is applied to the shaft 19 and the shaft 19 tries to move in a direction of S1. On the other hand, when the driving gear 18 is caused to rotate reversely in a direction of a rotational direction R2, the shaft 19 tries to move in a direction of S2. In this manner, the shaft 19 is displaced in the shaft support hole 60 which is formed into the long hole in accordance with the rotation of the driving gear 18.

Further, thereby, the conveyance screw 12 itself is displaced in the direction of S1 or S2. When a position of the conveyance screw 12 is displaced, it is possible to scrape the toner which is in the internal space 11*a* of the storage tank 11 or which is adhered to the wall surface of the toner conveyance path 24, the toner discharge port 16 and the like for conveying and discharging, and this makes it possible to prevent packing of the toner effectively.

In the configuration where the conveyance screw 12 is allowed to be displaced as described above, by further switching the rotational direction of the conveyance screw 12 to forward and reverse for driving, it is possible to prevent packing of the toner more effectively. In this case, a not-shown driving device that drives the driving gear 18 is controlled to switch the rotational direction of the driving gear 18 to forward and reverse. For example, by using a stepping motor as the driving device, a pulse signal for controlling the rotational direction of the stepping motor is switched, thus making it possible to switch the rotational direction of the driving gear 18 to forward and reverse.

Thereby, by switching the rotation of the conveyance screw 12 to forward and reverse, it is possible to scrape the toner remaining in the base end side and the tip end side of the conveyance screw 12 effectively and to prevent packing in the areas of the both ends of the conveyance screw 12 effectively.

For example, as shown in FIG. 11B, when the conveyance screw 12 is caused to rotate in the direction of the rotational direction r1, with the rotation of the conveyance screw 12, the toner remaining in the base end side of the conveyance screw 12 (driven gear side) is able to be scraped. Further, when the conveyance screw 12 is caused to rotate in the direction of the rotational direction r2, the toner remaining in the tip end side of the conveyance screw 12 (discharge port 16 side) is able to be scraped. That is, by rotating while switching the rotational direction of the conveyance screw 12 to forward and reverse, it is possible to prevent packing in the areas of the both ends of the conveyance screw 12 effectively.

In the above-described example, though the rotational direction of the conveyance screw 12 is switched to forward and reverse for driving in the configuration where the shaft support hole 60 is formed as the long hole so that the shaft 19 of the conveyance screw 12 is able to be displaced in one direction or the direction opposite thereto, the rotational direction of the conveyance screw 12 may be switched to forward and reverse in a mode having no configuration where the shaft support hole 60 is the long hole.

Note that, technical features described for each embodiment described above are able to be combined with each other and such combination makes it possible to form a new technical feature.

As above, according to the present invention, it is possible to provide a toner supplying device for supplying toner of a toner cartridge to a developing device, in which packing of the toner is prevented to allow the toner to be supplied stably, and an image forming apparatus provided with the toner supplying device.

The invention claimed is:

1. A toner supplying device having a toner cartridge attached to an upper part thereof and a storage tank in which toner supplied from the toner cartridge is stored temporarily and discharging the toner from a toner discharge port provided in a lower end of the storage tank, wherein a conveyance screw for discharging the toner stored in the storage tank temporarily to the toner discharge port is provided inside the storage tank, and the storage tank has a shaft support hole for supporting a shaft of the conveyance screw that coincides with a rotational center axis of the conveyance screw and the shaft support hole is formed as a long hole in which the shaft is able to be displaced in one direction or a direction opposite to the one direction, wherein a driving portion for rotationally driving the conveyance screw is included, a driving gear that is driven by the driving portion and a driven gear attached to the shaft are engaged to rotationally drive the conveyance screw, and rotation of the driving gear allows a position of the shaft supported in the long hole to be displaced.

2. The toner supplying device according to claim 1, wherein the driving portion switches a rotational direction of the conveyance screw to both forward and reverse for driving.

3. The toner supplying device according to claim 1, wherein the conveyance screw is provided so that a rotational axis coincides with a horizontal direction at a lower part of the storage tank, the storage tank has a bottom part wall having a shape along an external shape of the conveyance screw, the toner discharge port is provided in a portion of area of the bottom part wall that is in an axis direction of the conveyance screw, and the rotation of the conveyance screw causes the toner stored in the lower part of the storage tank to be discharged downward from the toner discharge port.

4. An image forming apparatus including the toner supplying device according to claim 1 for performing image formation on a recording medium with toner supplied by the toner supplying device.

5. A toner supplying device having a toner cartridge attached to an upper part thereof and a storage tank in which toner supplied from the toner cartridge is stored temporarily and discharging the toner from a toner discharge port provided in a lower end of the storage tank, wherein the storage tank is provided with a conveyance screw for discharging the toner temporarily stored in the storage tank to the toner discharge port, the conveyance screw is provided so that a rotational center axis coincides with a horizontal direction at a lower part of the storage tank, the storage tank has a bottom part wall having a shape along an external shape of the conveyance screw at the lower part of the storage tank and side walls that are connected to the bottom part wall and extend toward an upper part of the storage tank in both sides with an axis of the conveyance screw sandwiched therebetween, and one side wall among the side walls in the both sides of the conveyance screw is extended upward in a vertical direction and the other side wall is inclined to an inner side of the storage tank only by an angle θ with respect to the vertical direction, and when a gap between an inner surface of the storage tank and a part where the conveyance screw has a maximum diameter is g, $0.3\ \text{mm} \leq g \leq 1.2\ \text{mm}$ and $15° \leq \theta \leq 45°$ are satisfied.

* * * * *